US005168958A

United States Patent [19]

Wullimann

[11] Patent Number: 5,168,958

[45] Date of Patent: Dec. 8, 1992

[54] ELEVATING AND LOWERING APPARATUS

[75] Inventor: Frank Wullimann, Bellach, Switzerland

[73] Assignee: Rollgliss AG Schweiz, Selzach, Switzerland

[21] Appl. No.: 773,535

[22] Filed: Oct. 9, 1991

[30] Foreign Application Priority Data

Oct. 10, 1990 [EP] European Pat. Off. ..... 90810778.2

[51] Int. Cl.[5] ..... B66D 5/00

[52] U.S. Cl. ..... 182/236; 182/5

[58] Field of Search ..... 182/231, 232, 234, 5, 182/71, 236, 237, 239; 254/391

[56] References Cited

U.S. PATENT DOCUMENTS

| | | | |
|---|---|---|---|
| 334,071 | 1/1886 | Clark | 182/5 X |
| 2,220,239 | 11/1940 | Haybeck . | |
| 2,990,131 | 6/1961 | Carlsson | 182/239 X |
| 3,759,346 | 9/1973 | Brda . | |
| 3,946,989 | 3/1976 | Tsuda | 182/5 X |
| 4,367,863 | 1/1983 | Dulondel et al. | 182/5 X |

FOREIGN PATENT DOCUMENTS

| | | |
|---|---|---|
| 413692 | 8/1910 | France . |
| 1551691 | 12/1968 | France . |
| 526308 | 9/1972 | Switzerland . |
| 1007645 | 10/1965 | United Kingdom . |

*Primary Examiner*—Alvin C. Chin-Shue
*Attorney, Agent, or Firm*—Marks & Murase

[57] ABSTRACT

The elevating and lowering apparatus comprises a baseplate (1) on which a freely rotatable lowering pulley (2) including a back-run safety is mounted. A toothed crown (7) is mounted on the side of the lowering pulley facing the baseplate, the teeth (*7a*) of the toothed crown cooperating with a ratchet member (9) in such a manner that in the freewheeling direction, the ratchet member is lifted, and in the reverse direction, the ratchet member blocks said toothed crown, i.e. the lowering pulley. Said ratchet member is accommodated in the baseplate. Such an additional back-run safety results in an increased security, and in some countries, it is mandatory for certain operations involving the apparatus.

9 Claims, 3 Drawing Sheets

ELEVATING AND LOWERING APPARATUS

The present invention refers to an elevating and lowering apparatus, comprising a baseplate on which a freely rotatable lowering pulley having a back-run safety including a number of spring-loaded clamper rollers is mounted. Such an apparatus is commercially available and officially approved in some countries as a lifesaving apparatus. The basic concept of the freely rotatable pulley reverts to an idea which was published in Swiss Pat. No. 526,308.

In order to extend the possible applications of such a lifesaving apparatus to further areas, it is necessary to provide another safety, and it is therefore the object of the present invention to provide an additional safety besides the back-run safety. This first object is attained by means of an elevating and lowering apparatus wherein said lowering pulley comprises means which provide a second back-run safety in conjunction with blocking means which are disposed on said baseplate.

For many tasks or rescuing operations involving a risk of falling, regulations prescribe an additional safety, e.g. a so-called dead man's safety which acts as an automatic blocking device in case that the assistant or the person to be lowered should lose hold of the rope. Therefore, the known and commercially available lifesaving apparatus includes a rope blocking handle, which is also disclosed in the above-mentioned patent specification. Situations may arise where said rope brake handle is missing, said handle being a separate, detached part. In this context, it is a further object of the present invention to integrate this automatic blocking device with the lifesaving apparatus permanently and in a space-economical manner. This object is attained by means of an elevating and lowering apparatus further comprising a blocking device which is integrated with said baseplate and which clamps the rope in the case of a sudden downward acceleration of the latter.

The invention is described in more detail hereinafter with reference to a drawing of an embodiment.

Figure 1:
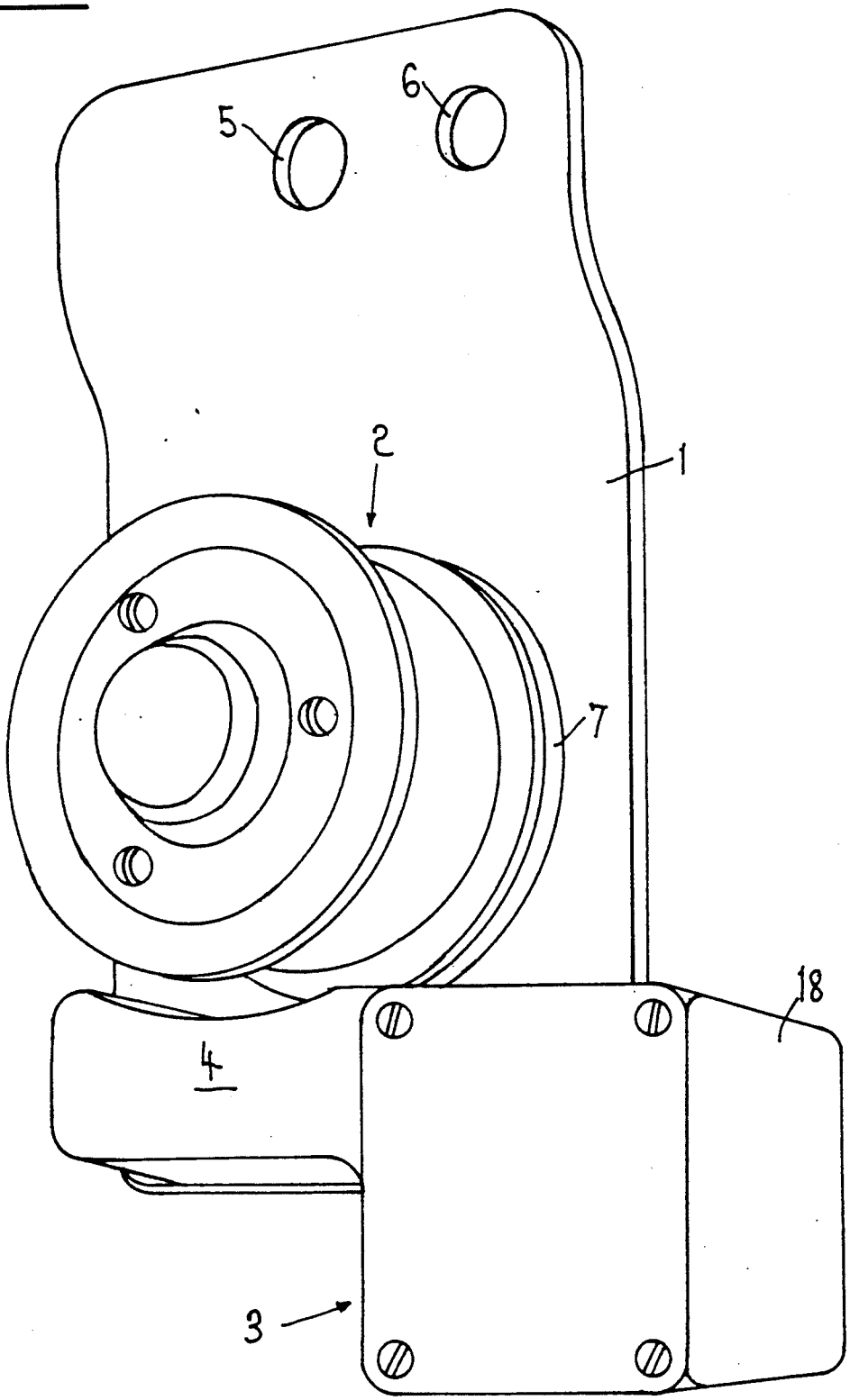
FIG. 1 shows the complete elevating and lowering apparatus of the invention in a perspective view.

FIG. 1 illustrates baseplate 1, lowering pulley 2 as well as blocking device 3, which is integrated with the baseplate and protected from atmospheric influences. Lowering pulley 2, as it appears in FIG. 1, is known and has been described in the above-mentioned patent specification; reference is particularly made to the back-run safety with clamper rollers which is disposed between two lifetime-lubricated ball-bearings which are sealed on both sides. During elevation, said lowering pulley rotates freely, and during the lowering operation, it is blocked by said clamper rollers. The rescuing rope is wound two and a half times around the lowering pulley, whereby a braking effect is obtained and only a minimal retaining force is required at the free end of the rope. Not represented is the special lateral rope guide, while the lower rope guide 4 is illustrated only schematically because it is known. The two openings 5 and 6 in baseplate 1 serve for the attachment of the lowering apparatus by means of a steel cable loop and of further apparatus.

Figure 2:
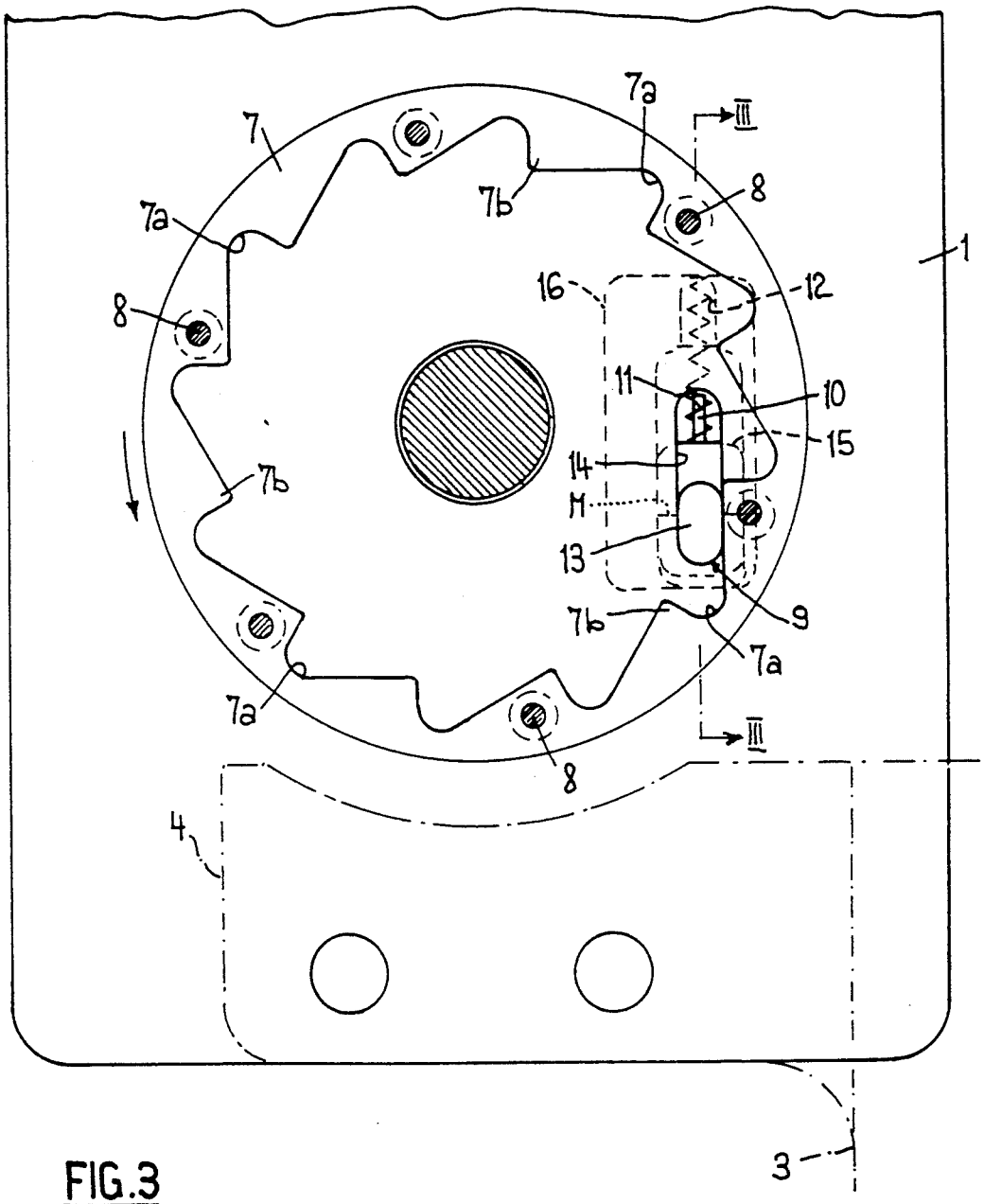
FIG. 2 shows a sectional view of the second back-run safety of the apparatus.
Figure 3:
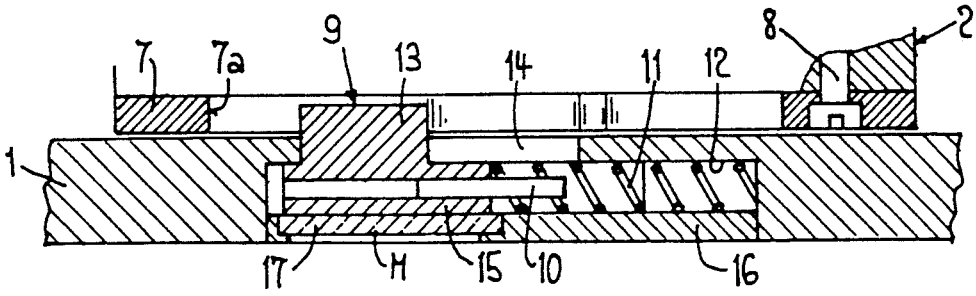
FIG. 3 shows a section according to line III—III in FIG. 2.

FIGS. 2 and 3 illustrate the second back-run safety, comprising a toothed crown 7 which is mounted on the side of lowering pulley 2 facing baseplate 1, e.g. by means of hexagonal socket screws 8. Said toothed crown cooperates with a ratchet member 9 in such a manner that the lowering pulley is allowed to rotate freely in the rotational direction which is indicated by the arrow, and is retained in the reverse direction The first back-run safety using said clamper rollers allows the same freewheeling operation and retention of the lowering pulley. In the present embodiment, said ratchet member is provided with a pin 10 around which a spring 11 is disposed which is fitted in a longitudinal bore 12 of said baseplate. Retaining pawl 13 of ratchet member 9 runs in a slot 14 and projects from the baseplate in order to be capable of engaging in the interdental spaces *7b* of said toothed crown, while the larger body 15 of said ratchet member runs in a corresponding cutout of said baseplate. As the lowering pulley, i.e. said toothed crown is rotated in the direction which is indicated by the arrow, the teeth *7a* will force said ratchet member towards the top of FIG. 2 against the pressure of spring 11, and in the reverse direction, said spring will push the retaining pawl of said ratchet member down into the retaining position. Ratchet member 9 is covered by plate 16 which is provided with a transparent window 17 in order to allow verification of the position of said ratchet member from the outside. For this purpose, the underside of said ratchet member body is advantageously provided with a mark M allowing, during rotation of said lowering pulley in the direction of the arrow, verification of whether said ratchet member is operating correctly or of whether if its replacement is required as a result of wear.

Figure 4:
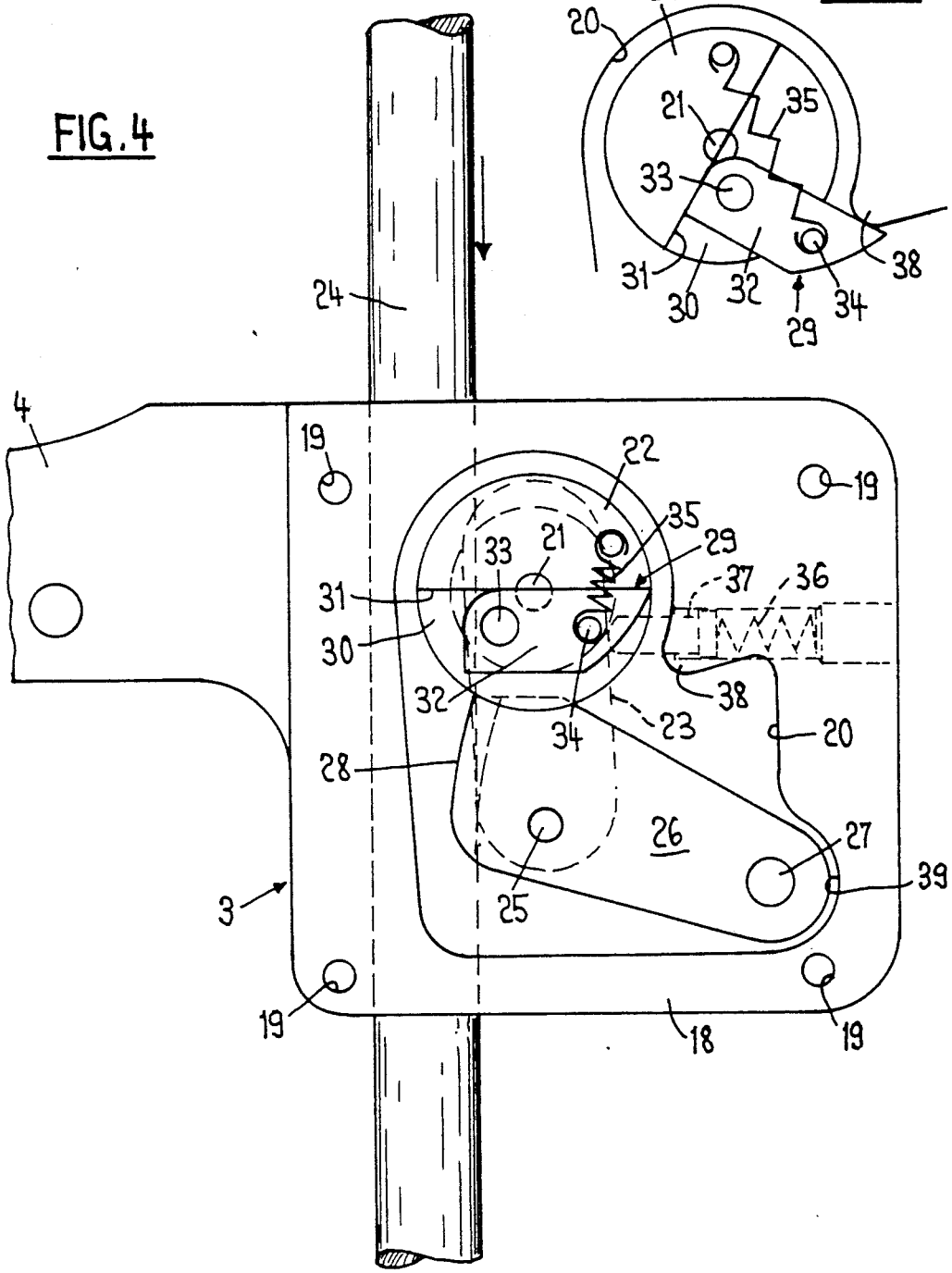
FIG. 4 shows the integrated automatic blocking device.

Blocking device 3 is enclosed in a housing of which only housing plate 18 is shown in FIG. 4, the cover being attachable by means of screws in bores 19. Said housing plate is provided with a formed cavity 20 wherein the elements of said blocking device are accommodated. Said blocking device comprises a pinch roller 22 rotating on axle 21, said pinch roller being connected to a lever 23. The exterior surface of pinch roller 22 is inwardly curved in order to surround rope 24. The other end of lever 23 is hinged on axle 25 and connected to a clamping lever 26 which is hinged on fixed axle 27. The front surface of said clamping lever 26 is also provided with a concave curvature in order to receive the rope.

Figure 5:
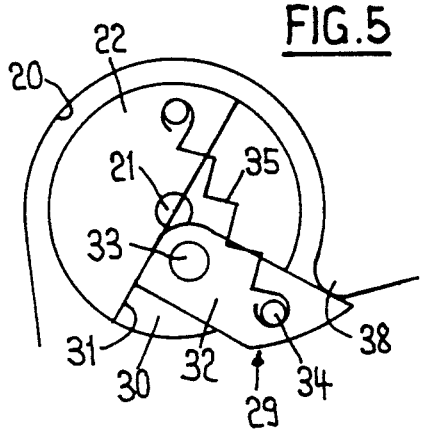
FIG. 5 shows a detail of said blocking device.

In the position as shown in FIG. 4, the rope moves past said pinch roller and said clamping lever and is only very slightly braked. Now, if the operator of the apparatus releases the other end of the rope for some reason and the rope is consequently accelerated downwards, i.e. in the direction of the arrow, a centrifugal trip 29 is provided to brake said movement. Said trip is located on the stepped front portion of said pinch roller, the shoulder 31 of said stepped portion passing through the center of the pinch roller, see FIG. 5. Said centrifugal trip 29 is composed of a tripping lever 32 which is hinged on axle 33 and which is provided in its rear third with a pin 34 to which one end of a tension spring 35 is attached whose other end is secured to said pinch roller. In the position as shown in FIG. 4, spring 35 retains tripping lever 32 in its retracted position. Moreover, a pressure spring 36 is acting via pin 37 upon lever 23 and thus upon pinch roller 22 so that the latter is pressed against the rope and caused to rotate therewith when the rope is moving downwards. Now, if the other end of the rope is either released or torn off, a strong downward acceleration of the illustrated rope end at the blocking device results, whereby said centrifugal trip is whirled around and brought into the position of FIG. 5 where the free end of tripping lever 32 abuts to nose 38 of cavity 20. Thus the pinch roller is blocked, on one hand, and pressed against the rope, on the other hand, due to the leverage of said trip lever. Furthermore, lever 23 is activated, which in turn forces clamping lever 26 into the direction of the rope, whereby a double clamping action of the pinch roller and the clamping lever is achieved. This results in a quick, complete blocking of the rope in the blocking device. Due to the fact that axle 27 of said clamping lever is journalled in a recess 39 of cavity 20, the effect of the clamping lever is conserved even if axle 27 should break.

I claim:

1. An elevating and lowering apparatus, comprising a baseplate on which a freely rotatable lowering pulley having a back-run safety including a number of spring-loaded clamper rollers is mounted, wherein said lowering pulley comprises means which provide a second back-run safety in conjunction with blocking means which are disposed on said baseplate.

2. The apparatus of claim 1, wherein said means of said lowering pulley comprise a toothed crown which cooperates with a spring-loaded ratchet member which is accommodated in said baseplate, said ratchet member having a retaining pawl for engaging the teeth of said toothed crown, said teeth being formed in such a manner that they lift the retaining pawl of said ratchet member when said lowering pulley rotates in a freewheeling direction and that they press upon said retaining pawl when said lowering pulley rotates in a reverse direction.

3. The apparatus of claim 2, wherein said baseplate is provided with a transparent window at the location of said retaining pawl in order to allow verification of the movement and the wear of the latter.

4. The apparatus of claim 1, further comprising a blocking device which is integrated with said baseplate and which clamps the rope in the case of a sudden downward acceleration of the latter.

5. An elevating and lowering apparatus, comprising a baseplate on which a freely rotatable lowering pulley having a back-run safety including a number of spring-loaded clamper rollers is mounted, wherein said lowering pulley comprises means which provide a second back-run safety in conjunction with blocking means which are disposed on said baseplate, and a blocking device which is integrated with said baseplate and which clamps the rope in the case of a sudden downward acceleration of the latter, wherein said blocking device comprises a pinch roller, the axle of which is connected to a lever which is subject to the action of a pressure spring in order to press said pinch roller against the rope and whose other end is freely movable and connected to a clamping lever, as well as a centrifugal trip which comprises a tripping lever which is hinged on a stepped portion of the front side of said pinch roller and whose other end is maintained in its position by a tension spring, said tripping lever being caused to abut against a nose of said housing plate by any sudden acceleration of the rope, whereby said pinch roller and, via said lever, said clamping lever are pressed against the rope.

6. An elevating and lowering apparatus comprising;

a baseplate;

a freely rotatable elevating and lowering pulley mounted on said baseplate;

a first back-run safety including a number of spring-loaded clamper rollers attached to said pulley such that said pulley rotates freely in a first direction and is blocked by said clamper rollers in a reverse direction whereby a braking effect is obtained; and a second back-run safety including a toothed crown which cooperate with a spring loaded ratchet member is attached to said pulley such that said pulley rotates freely in said first direction and is retained in said reverse direction.

7. An elevating and lowering apparatus as defined in claim 6, wherein said ratchet member has a retaining pawl for engaging the teeth of said toothed crown, said teeth being formed in such a manner that they lift a retaining pawl of said ratchet member in said first direction and press upon said retaining pawl in said reverse direction.

8. An elevating and lowering apparatus as defined in claim 7, wherein said baseplate is provided with a transparent window at the location of said retaining pawl in order to allow verification of the movement and the wear of the latter.

9. An elevating and lowering apparatus as defined in claim 6, further comprising a blocking device which is integrated with said baseplate and which clamps the rope in the case of a sudden downward acceleration of the latter.

* * * * *